US008788264B2

(12) United States Patent
Shimada

(10) Patent No.: US 8,788,264 B2
(45) Date of Patent: Jul. 22, 2014

(54) AUDIO ENCODING METHOD, AUDIO DECODING METHOD, AUDIO ENCODING DEVICE, AUDIO DECODING DEVICE, PROGRAM, AND AUDIO ENCODING/DECODING SYSTEM

(75) Inventor: Osamu Shimada, Tokyo (JP)

(73) Assignee: NEC Corporation, Tokyo (JP)

( * ) Notice: Subject to any disclaimer, the term of this patent is extended or adjusted under 35 U.S.C. 154(b) by 934 days.

(21) Appl. No.: 12/452,213

(22) PCT Filed: Jun. 25, 2008

(86) PCT No.: PCT/JP2008/061580

§ 371 (c)(1),
(2), (4) Date: Dec. 22, 2009

(87) PCT Pub. No.: WO2009/001874

PCT Pub. Date: Dec. 31, 2008

(65) Prior Publication Data

US 2010/0106509 A1 Apr. 29, 2010

(30) Foreign Application Priority Data

Jun. 27, 2007 (JP) ..... 2007-169058

(51) Int. Cl.
*G10L 21/00* (2013.01)
*G10L 25/90* (2013.01)
*G10L 19/00* (2013.01)

(52) U.S. Cl.
USPC ..... 704/205; 704/206; 704/207; 704/230

(58) Field of Classification Search
USPC ..... 704/205–207, 230
See application file for complete search history.

(56) References Cited

U.S. PATENT DOCUMENTS 5,268,991 A * 12/1993 Tasaki ..... 704/220
5,517,595 A * 5/1996 Kleijn ..... 704/205
5,960,390 A * 9/1999 Ueno et al. ..... 704/200.1
6,154,499 A * 11/2000 Bhaskar et al. ..... 375/259
6,470,313 B1 * 10/2002 Ojala ..... 704/223
6,529,604 B1 3/2003 Park et al.
6,625,574 B1 * 9/2003 Taniguchi et al. ..... 704/229
6,704,705 B1 * 3/2004 Kabal et al. ..... 704/230
6,778,966 B2 * 8/2004 Bizjak ..... 704/500

(Continued)

FOREIGN PATENT DOCUMENTS

JP 11-317672 11/1999
JP 2001-094432 A 4/2001

(Continued)

OTHER PUBLICATIONS

Japanese Office Action dated Jul. 23, 2013 with a partial English translation.

*Primary Examiner* — Eric Yen
(74) *Attorney, Agent, or Firm* — McGinn IP Law Group, PLLC

(57) ABSTRACT

An audio encoding device (1A) corrects initial gain information calculated for an arbitrary frame, based on gain information of a stored past frame, thereby calculating gain information to be used in the frame. The audio encoding device (1A) encodes the calculated gain information as a difference from the gain information of the past frame. An audio decoding device (3A) receives the differential gain, and calculates the gain of the arbitrary frame based on the gain used in the past frame, thereby generating a decoded audio signal.

21 Claims, 8 Drawing Sheets

(56) References Cited

U.S. PATENT DOCUMENTS

| | | | | |
|---|---|---|---|---|
| 6,978,236 | B1 * | 12/2005 | Liljeryd et al. | 704/219 |
| 7,016,831 | B2 * | 3/2006 | Suzuki et al. | 704/203 |
| 7,135,636 | B2 * | 11/2006 | Kemmochi et al. | 84/622 |
| 7,181,389 | B2 * | 2/2007 | Liljeryd et al. | 704/219 |
| 7,590,532 | B2 * | 9/2009 | Suzuki et al. | 704/230 |
| 7,864,967 | B2 * | 1/2011 | Takeuchi et al. | 381/56 |
| 7,933,769 | B2 * | 4/2011 | Bessette | 704/219 |
| 8,019,601 | B2 * | 9/2011 | Eguchi | 704/230 |
| 8,255,212 | B2 * | 8/2012 | Villemoes | 704/229 |
| 2002/0052734 | A1 * | 5/2002 | Unno et al. | 704/207 |
| 2002/0077812 | A1 * | 6/2002 | Suzuki et al. | 704/230 |
| 2003/0112979 | A1 | 6/2003 | Toyama et al. | |
| 2006/0115092 | A1 | 6/2006 | Toyama et al. | |
| 2006/0277039 | A1 * | 12/2006 | Vos et al. | 704/219 |
| 2007/0147518 | A1 * | 6/2007 | Bessette | 375/243 |
| 2007/0271102 | A1 | 11/2007 | Morii | |

FOREIGN PATENT DOCUMENTS

| | | |
|---|---|---|
| JP | 2001-94433 | 4/2001 |
| JP | 2002-268693 | 9/2002 |
| JP | 2006-72026 | 3/2006 |
| WO | WO 02/052732 A1 | 7/2002 |

* cited by examiner

AUDIO ENCODING METHOD, AUDIO DECODING METHOD, AUDIO ENCODING DEVICE, AUDIO DECODING DEVICE, PROGRAM, AND AUDIO ENCODING/DECODING SYSTEM

TECHNICAL FIELD

The present invention relates to an audio encoding/decoding technique and, more particularly, to a technique of encoding/decoding gain information to be used in scaling of an audio signal.

BACKGROUND ART

A method using subband coding is widely known as a technique capable of encoding a general audio signal (acoustic signal/sound signal) with a small information amount, and obtaining a high-quality reproduction signal. A representative example of coding using this subband is MPEG-2AAC (Advanced Audio Coding) as an international standard method of ISO/IEC.

When performing coding by the AAC method, scaling and quantization represented by equation (1) below are performed for each band including a plurality of signals X obtained by converting the frequency of a time signal. In the following equation, abs(X) is the absolute value of X, G is gain information, and α is an appropriate constant value.

[Mathematical 1]

$$Xq = \mathrm{int}\left(\left(\mathrm{abs}(X)\cdot 2^{\frac{1}{4}(G-100)}\right)^{\frac{3}{4}} + \alpha\right) \tag{1}$$

The signal X is scaled by using common gain information G in a certain band, and the scaled signal is quantized. The gain information G is determined based on the characteristics of an audio signal and human auditory characteristics.

The quantized signal Xq and gain information G are encoded, and the encoded information is written in a bit stream. The gain information G is represented by an initial value A and a gain difference d_scf from an adjacent band represented by equation (2) below. In the following equation, i is the index of a band number, and G(−1) is the initial value A.

[Mathematical 2]

$$d_scf(i)=G(i)-G(i-1) \tag{2}$$

The AAC method encodes the initial value A by eight bits, and performs Huffman encoding on the gain difference. The Huffman code length herein used is designed to decrease when the absolute value of the gain difference is small and increase when the absolute value of the gain difference is large. On the decoding side, the gain information G is generated from the initial value A and the Huffman-decoded gain difference d_scf in accordance with equation (3) below. In the following equation, i is the index of a band number, and G(−1) is the initial value A.

[Mathematical 3]

$$G(i)=d_scf(i)+G(i-1) \tag{3}$$

Then, inverse quantization is performed in accordance with equation (4) below by using the gain information G and quantized signal Xq. An output audio signal is obtained by converting the inversely quantized signal X into the time signal.

[Mathematical 4]

$$\underline{X} = Xq^{\frac{4}{3}}\cdot 2^{\frac{1}{4}(G-100)} \tag{4}$$

The method disclosed in Japanese Patent Laid-Open No. 2002-268693 is a conventional example of decreasing the code rate of the gain difference. FIG. 10 is a block diagram showing the arrangement of the conventional audio encoding/decoding apparatus. Referring to FIG. 10, in this conventional method of decreasing the gain difference, a frequency band integrator integrates a plurality of bands, and a gain calculator calculates a common gain of the plurality of bands. The method reduces the code rate of the gain information by reducing the Huffman code rate by setting 0 as the difference between the bands using the common gain.

DISCLOSURE OF INVENTION

Problems to be Solved by the Invention

Unfortunately, the conventional technique as described above is insufficient to reduce the code rate of the gain information because the initial gain A must always be encoded. Also, the technique described in patent reference 1 applies the same gain to a plurality of frequency bands. Since no fine control can be performed for each band as a minimum unit, the sound quality is unsatisfactory.

The present invention has been made to solve the above problems, and has as its object to provide an audio encoding method, audio decoding method, audio encoding device, audio decoding device, program, and audio encoding/decoding system capable of efficiently reducing the code rate of the gain information, and performing high-quality encoding/decoding.

Means for Solving the Problems

To achieve the above object, an audio encoding method according to the present invention comprises the orthogonal transformation step of transforming an input audio signal into a frequency signal for each frame, the gain calculation step of calculating, for each band including a plurality of frequency signals, a gain for scaling the frequency signal obtained in the orthogonal transformation step, and correcting each gain by using a past gain used in a past frame, thereby calculating a corrected gain, the quantization step of generating a quantized signal by scaling and quantizing the frequency signal for each band by using the corrected gain obtained in the gain calculation step, the gain encoding step of generating gain information by encoding, for each band, a difference between the corrected gain obtained in the gain calculation step and the corresponding past gain as the gain information, and the multiplexing step of generating encoded audio data by multiplexing, for each band, the quantized signal obtained in the quantization step and the gain information obtained in the gain encoding step.

An audio decoding method according to the present invention comprises the demultiplexing step of demultiplexing, for each band including a plurality of frequency signals, quantized signal information and gain information for scaling the quantized signal from encoded audio data input frame by frame, the storage step of storing a gain used in a past frame in a memory for each band, the gain decoding step of decoding a gain of a frame of interest for each band by using a past frame gain acquired from the memory and a differential gain contained in the gain information demultiplexed in the demultiplexing step, the inverse quantization step of inversely quantizing and scaling the quantized signal information demultiplexed in the demultiplexing step for each band based on the gain obtained in the gain decoding step, thereby generating a frequency signal, and the orthogonal transformation step of generating a decoded audio signal by orthogonally transforming the frequency signal obtained in the inverse quantization step.

An audio encoding device according to the present invention comprises an orthogonal transformer which transforms an input audio signal into a frequency signal for each frame, a gain calculator which calculates, for each band including a plurality of frequency signals, a gain for scaling the frequency signal obtained by the orthogonal transformer, and corrects each gain by using a past gain used in a past frame, thereby calculating a corrected gain, a quantizer which generates a quantized signal by scaling and quantizing the frequency signal for each band by using the corrected gain obtained by the gain calculator, a gain encoder which generates gain information by encoding, for each band, a difference between the corrected gain obtained by the gain calculator and the corresponding past gain as the gain information, and a multiplexer which generates encoded audio data by multiplexing, for each band, the quantized signal obtained by the quantizer and the gain information obtained by the gain encoder.

An audio decoding device according to the present invention comprises a demultiplexer which demultiplexes, for each band including a plurality of frequency signals, quantized signal information and gain information for scaling the quantized signal from encoded audio data input frame by frame, a memory which stores a gain used in a past frame for each band, a gain decoder which decodes a gain of a frame of interest for each band by using a past frame gain acquired from the memory and a differential gain contained in the gain information demultiplexed by the demultiplexer, an inverse quantizer which inversely quantizes and scales the quantized signal information demultiplexed by the demultiplexer for each band based on the gain obtained by the gain decoder, thereby generating a frequency signal, and an orthogonal transformer which generates a decoded audio signal by orthogonally transforming the frequency signal obtained by the inverse quantizer.

A program according to the present invention is a program for causing a computer of an audio encoding device to execute the audio encoding method described above.

Also, a program according to the present invention is a program for causing a computer of an audio decoding device to execute the audio decoding method described above.

An audio encoding/decoding system according to the present invention comprises an audio encoding device which generates encoded audio data by encoding an input audio signal, and an audio decoding device which generates a decoded audio signal by decoding the encoded audio data generated by the audio encoding device, the audio encoding device comprising an orthogonal transformer which transforms an input audio signal into a frequency signal for each frame, a gain calculator which calculates, for each band including a plurality of frequency signals, a gain for scaling the frequency signal obtained by the orthogonal transformer, and corrects each gain by using a past gain used in a past frame, thereby calculating a corrected gain, a quantizer which generates a quantized signal by scaling and quantizing the frequency signal for each band by using the corrected gain obtained by the gain calculator, a gain encoder which generates gain information by encoding, for each band, a difference between the corrected gain obtained by the gain calculator and the corresponding past gain as the gain information, and a multiplexer which generates encoded audio data by multiplexing, for each band, the quantized signal obtained by the quantizer and the gain information obtained by the gain encoder, and the audio decoding device comprising a demultiplexer which demultiplexes, for each band including a plurality of frequency signals, quantized signal information and gain information for scaling the quantized signal from encoded audio data generated by the audio encoding device and input frame by frame, a memory which stores a gain used in a past frame for each band, a gain decoder which decodes a gain of a frame of interest for each band by using a past frame gain acquired from the memory and a differential gain contained in the gain information demultiplexed by the demultiplexer, an inverse quantizer which inversely quantizes and scales the quantized signal information demultiplexed by the demultiplexer for each band based on the gain obtained by the gain decoder, thereby generating a frequency signal, and an orthogonal transformer which generates a decoded audio signal by orthogonally transforming the frequency signal obtained by the inverse quantizer.

Effects of the Invention

The present invention corrects the gain information from the past frame gain and initial gain so as to suppress the gain code rate without increasing the quantization distortion amount. This makes it possible to control the gain for a band as a minimum unit, and reduce the code rate of the gain information. It is also possible to improve the sound quality with a small calculation amount by calculating the gain in accordance with predetermined transform expressions. Consequently, high-quality audio encoding and decoding methods, devices, and programs can be implemented because the suppressed gain code rate can be used as the code rate of the quantized signal. Furthermore, since the gain code rate is suppressed, high-quality audio encoding and decoding methods, devices, and programs can be implemented with a bit rate lower than the conventional bit rate.

BEST MODE FOR CARRYING OUT THE INVENTION

Embodiments of the present invention will be explained below with reference to the accompanying drawings.

[First Embodiment]

Figure 1:
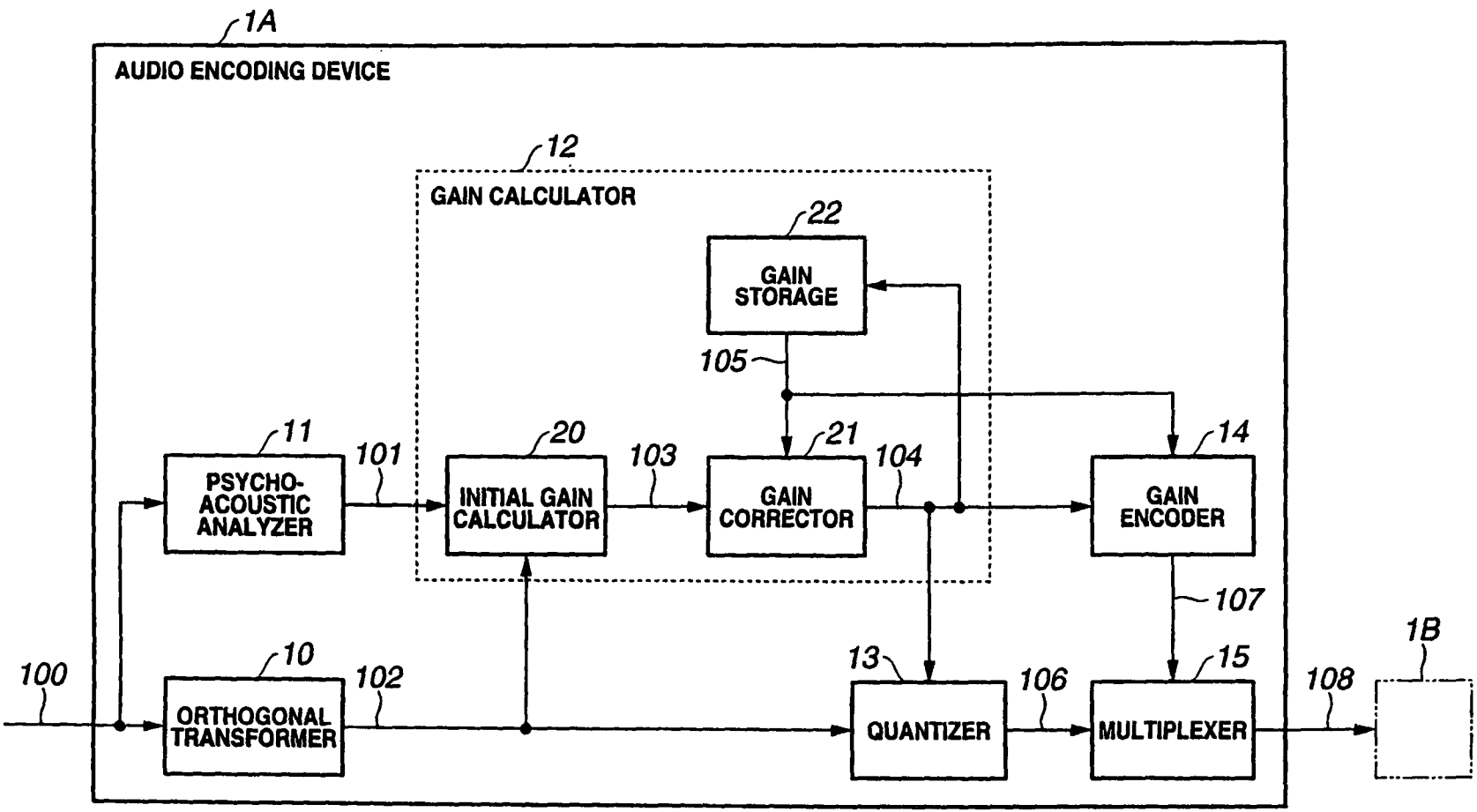
FIG. 1 is a block diagram showing the arrangement of an audio encoding device according to the first embodiment of the present invention.

First, an audio encoding device according to the first embodiment of the present invention will be explained below with reference to FIG. 1. FIG. 1 is a block diagram showing the arrangement of the audio encoding device according to the first embodiment of the present invention.

An audio encoding device 1A has a function of encoding an input audio signal 100 and outputting a bit stream 108, and includes, as main functional units, an orthogonal transformer 10, psycho-acoustic analyzer 11, gain calculator 12, quantizer 13, gain encoder 14, and multiplexer 15.

In this embodiment, the orthogonal transformer 10 converts an input audio signal into a frequency signal for each frame. The gain calculator 12 calculates a gain for scaling the frequency signal obtained by the orthogonal transformer 10 for each band including a plurality of frequency signals, and calculates a corrected gain by correcting each of these gains by using a past gain used in a past frame. The quantizer 13 scales and quantizes the frequency signal for each band by using the corrected gain obtained by the gain calculator 12, thereby generating a quantized signal. The gain encoder 14 generates gain information by encoding, for each band, the difference between the corrected gain obtained by the gain calculator 12 and the corresponding past gain as the gain information. The multiplexer 15 generates encoded audio data by multiplexing, for each band, the quantized signal obtained by the quantizer 13 and the gain information obtained by the gain encoder 14.

The orthogonal transformer 10 divides an input audio signal 100 (time signal) for each frame, thereby transforming the input audio signal 100 into a frequency signal 102. An example of the method of orthogonal transformation is MDCT (Modified Discrete Cosine Transform). The frequency signal can also be calculated by a method such as DCT (Discrete Cosine Transform), DFT (Discrete Fourier Transform), or subband transformation.

The psycho-acoustic analyzer 11 calculates permissible quantization noise (a masking threshold value) 101 so that quantization noise generated during quantization is not perceived, from the characteristics of the input audio signal 100, the human auditory characteristics, and the bit rate. High-quality permissible quantization noise can be calculated by positively using the masking effect by which the sound of a frequency close to that of a large sound cannot easily be heard. The permissible quantization noise 101 is calculated for each band including a plurality of frequency signals. The band width is made small for a low frequency band and large for a high frequency band in accordance with the human auditory characteristics.

The gain calculator 12 calculates a corrected gain 104 to be used to scale the frequency signal when quantizing the frequency signal as indicated by equation (1) presented earlier. Also, the gain calculator 12 outputs past gain information 105 containing a gain G_old of a certain past frame and frame number information of the past gain.

The gain encoder 14 encodes the difference between the gain G_old of the certain past frame and the corrected gain 104 for use in the frame of interest. This differential gain is calculated for each band. Letting G be the gain used in the quantization of the frame of interest, the differential gain to be encoded is represented by equation (5) below. In the following equation, i is the index of the band number.

[Mathematical 5]

$$d_scf(i)=G(i)-G_\mathrm{old}(i) \tag{5}$$

Frame number information d_frame represented by equation (6) below is calculated from a frame number F_old of the past gain G_old used when calculating the differential gain and a frame number F of the frame of interest.

[Mathematical 6]

$$d_\mathrm{frame}=F-F_\mathrm{old}-1 \tag{6}$$

The information amounts of the differential gain and frame number information can further be reduced by performing entropy coding such as Huffman coding. When using a Huffman code, the code rate can be reduced by designing the code length such that it decreases as the absolute value of the differential gain decreases. This is so because a signal change in the time direction is moderate in many cases. This similarly applies to the frame number information; the code rate of the information can be reduced by designing the code length such that it decreases as the value of d_frame decreases. The gain encoder 14 encodes the differential gain and frame number information by the above-mentioned method, and outputs gain information 107.

The quantizer 13 scales a frequency signal X for each band as represented by equation (1) by using the gain G calculated by the gain calculator 12, and quantizes the scaled frequency signal for each band, thereby calculating a quantized signal Xq (106). The information amount of the quantized signal Xq is reduced by performing entropy coding such as Huffman coding.

The multiplexer 15 multiplexes the gain information 107 and quantized signal 106 for each band, and outputs encoded audio data, i.e., a bit stream 108.

[Gain Calculator]

The operation of the gain calculator 12 will be explained in more detail below.

The gain calculator 12 includes an initial gain calculator 20, gain corrector 21, and gain storage 22 as main functional units.

The initial gain calculator 20 calculates, for each band, an initial gain 103 for scaling the frequency signal 102, from the permissible quantization noise 101 and frequency signal 102. The gain is used to scale the frequency signal when quantizing the frequency signal by applying equation (1). The initial gain 103 can be calculated by repeating the processing a plurality of number of times so that the quantization noise falls within the range of the permissible quantization noise, or calculated by using a predetermined transforming expression.

The gain storage 22 stores a gain and frame number used in a past frame, and outputs the past gain information 105 containing the gain and frame number of the past frame to the gain corrector 21 and gain encoder 14.

Figure 2:
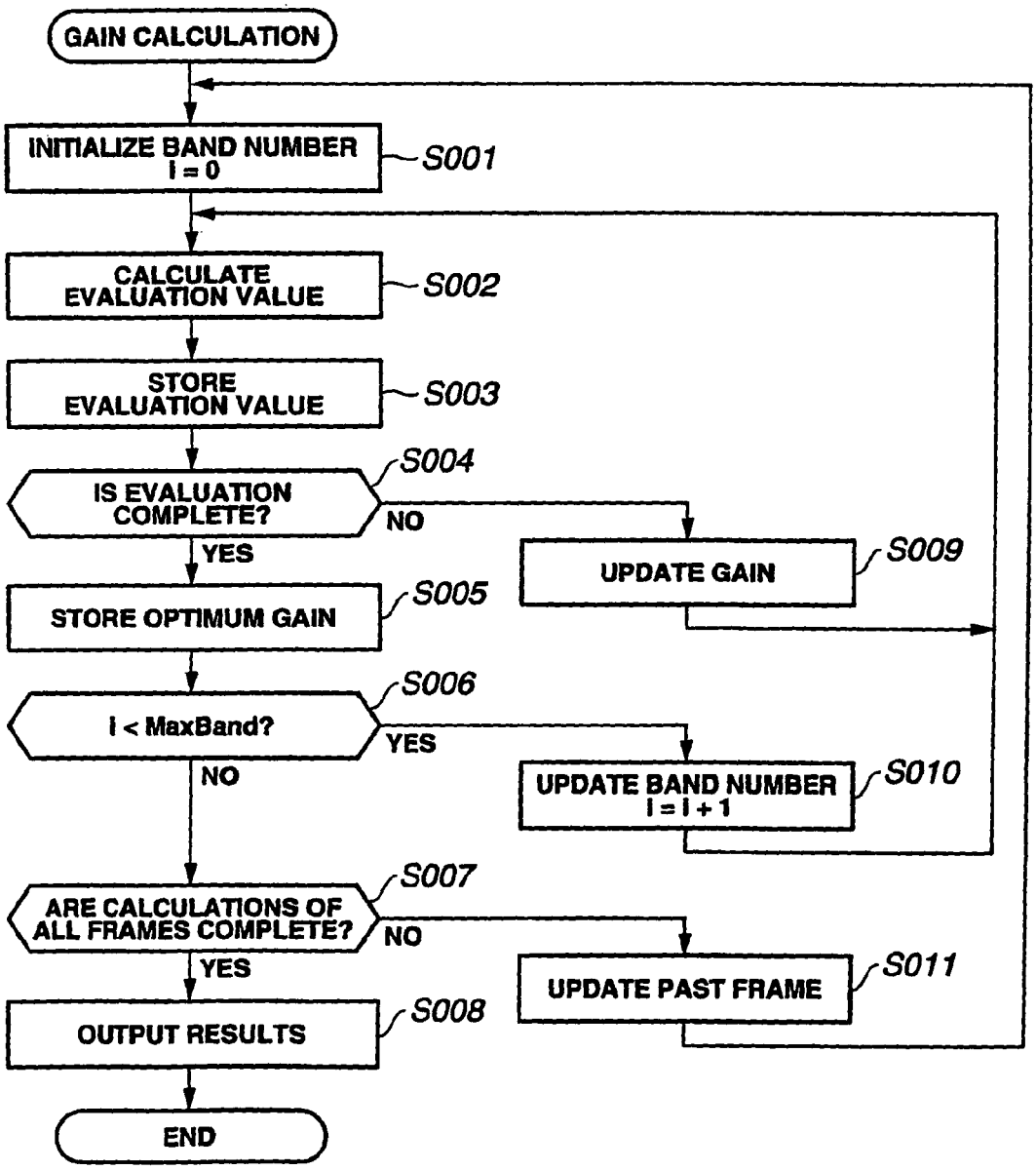
FIG. 2 is a flowchart showing a gain correcting operation in the audio encoding device according to the first embodiment of the present invention.

The gain corrector 21 corrects the gain so as to reduce the code rate of the gain information without increasing the quantization distortion. FIG. 2 is a flowchart showing a gain calculating operation in the audio encoding device according to the first embodiment of the present invention. The gain corrector 21 corrects the gains of all bands for the gain of a certain past frame k.

First, the initial value of the band number i to be corrected is set to 0 (step S001), and an evaluation value Eval is calculated from an evaluation function f_distortion pertaining to the quantization distortion of the band i and an evaluation function f_gain pertaining to the gain code rate as indicated by equation (7) below (step S002). In the following equation, G_1 is the initial gain, and G is the updated gain. G_old(k,i) is the gain of the past frame k, and is a past frame gain to be used to encode the gain. X is the frequency signal. When G=G_1, the evaluation value Eval is 0.

[Mathematical 7]

$$\mathrm{Eval}(k,i)=F(f_\mathrm{distortion}_i(G_1(i),G(i),X),f_\mathrm{gain}_i(G_1(i),G(i),G_\mathrm{old}(k,i))) \quad (7)$$

The evaluation value Eval as the calculation result obtained by equation (7) and the updated gain G are stored (step S003). Whether evaluation values have been calculated for all possible gains is checked (step S004). If evaluation values have not been calculated for all the gains, the gain is updated (step S009), and an evaluation value is recalculated for the new gain. If evaluation values have been calculated for all the gains, a gain having a minimum evaluation value among the evaluation values Eval stored in step S003 is set as the corrected gain of the band i (step S005).

Let MaxBand be a maximum value of the frequency band to be calculated. If i<MaxBand (step S006), the value of the band number i is updated (step S010), and the gain of the next frequency band is corrected. If the corrected gains have been calculated for all bands, the evaluation value of the past frame k is set as the sum of evaluation values when using the corrected gains of all the bands. Whether evaluation values have been calculated for all calculable past frames is checked (step S007). If there is a calculable past frame, the value of the past frame k is updated (step S011), and the evaluation value of the new past frame is calculated.

If the evaluation values of all the past frames have been calculated, a frame having a minimum past frame evaluation value is selected as a past frame, and the frame k and corrected gain are output (step S008).

For example, the function F of equation (7) can be represented by the sum of the evaluation function f_distortion pertaining to the quantization distortion and the evaluation function f_gain pertaining to the gain code rate. It is also possible to calculate a highly accurate evaluation value by performing linear transform or complicated nonlinear transform.

The evaluation function f_distortion pertaining to the quantization distortion is calculated from a distortion amount that increases or decreases when the gain is changed from G_1(*i*) to G(i). For example, the increase or decrease of the distortion amount can be calculated by calculating the quantization distortion by actually performing quantization. The quantization distortion amount is transformed into the output value of the evaluation function f_distortion by adding or multiplying the transform coefficient. It is also possible to calculate a highly accurate evaluation value by performing linear transform or complicated nonlinear transform. As another example, the evaluation value can also be calculated by using an approximate expression without calculating the increase or decrease of the actual quantization distortion, in order to reduce the calculation amount.

The evaluation function f_gain pertaining to the gain code rate is calculated from the gain code rate that increases or decreases when the gain is changed from G_1(*i*) to G(i). For example, the increase or decrease of the gain code rate can be calculated by actually encoding the gain. The gain code rate is transformed into the output value of the evaluation function f_gain by adding or multiplying the transform coefficient. It is also possible to calculate a highly accurate evaluation value by performing linear transform or complicated nonlinear transform. As another example, the evaluation value can also be calculated by using an approximate expression without calculating the increase or decrease of the actual gain code rate, in order to reduce the calculation amount.

The above-mentioned evaluation value is calculated from the evaluation function f_distortion pertaining to the quantization distortion, and the evaluation function f_gain pertaining to the gain code rate. However, the valuation value can also be calculated by using an evaluation function f_quantize calculated from the quantization code rate. The evaluation function f_quantize calculated from the quantization code rate is calculated from a code rate when encoding a quantized signal that increases or decreases when the gain is changed from G_1(*i*) to G(i). For example, the evaluation function f_quantize can be calculated from the increase or decrease of a code rate when encoding is performed by actually performing quantization.

The code rate of the quantized signal is transformed into the output value of the evaluation function f_quantize by adding or multiplying the transform coefficient. It is also possible to calculate a highly accurate evaluation value by performing linear transform or complicated nonlinear transform. As another example, the evaluation value can also be calculated by using an approximate expression without calculating the increase or decrease of the code rate of the quantized signal, in order to reduce the calculation amount.

When using the evaluation function f_quantize calculated from the quantization code rate, the gain can be corrected so as not to change or increase the quantization code rate even when the gain is changed from G_1(*i*) to G(i). Thus, a high-quality evaluation value can be calculated by using the evaluation function f_quantize calculated from the quantization code rate.

The evaluation value Eval can be calculated from these three evaluation functions by, e.g., using the sum of the evaluation values of the three evaluation functions, or performing linear transform or complicated nonlinear transform. The evaluation value Eval may also be calculated from the evaluation value or values of one or two evaluation functions selected from the three evaluation functions.

Furthermore, the calculation amount and memory amount can be reduced by restricting the range of possible gains or past frames.

The evaluation function f_distortion pertaining to the quantization distortion, the evaluation function f_gain pertaining to the gain code rate, and the evaluation function f_quantize calculated from the quantization code rate can be changed in accordance with the band number i. For example, when the band number is small, i.e., when the frequency component is low, an auditory impression is largely influenced. In this case, therefore, the gain can be corrected without degrading the quality by designing the evaluation functions so as to output evaluation values larger than those in a high-frequency band.

In this embodiment as described above, the gain information is corrected from the past frame gain and initial gain so as to suppress the gain code rate without increasing the quantization distortion amount. This makes it possible to control the gain for each band as a minimum unit, and reduce the code rate of the gain information. It is also possible to improve the sound quality with a small calculation amount by calculating the gain in accordance with predetermined transform expressions.

Consequently, high-quality encoding can be performed because the suppressed gain code rate can be used as the code rate of the quantized signal.

[Second Embodiment]

Figure 3:
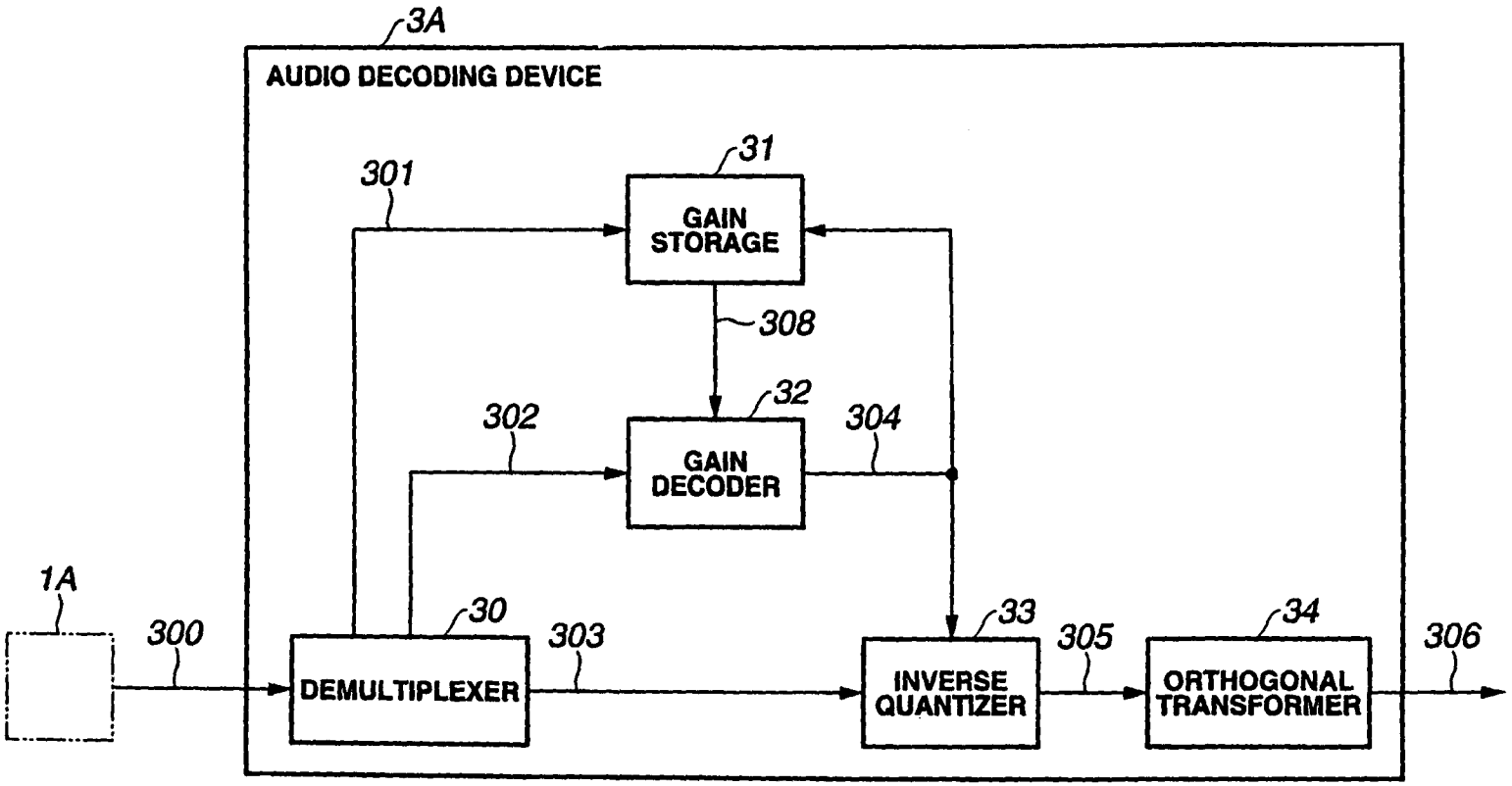
FIG. 3 is a block diagram showing the arrangement of an audio decoding device according to the second embodiment of the present invention.

An audio decoding device according to the second embodiment of the present invention will be explained below with reference to FIG. 3. FIG. 3 is a block diagram showing the arrangement of the audio decoding device according to the second embodiment of the present invention.

An audio decoding device 3A has a function of decoding the bit stream output from the above-mentioned audio encoding device and outputting the decoded signal, and includes, as main functional units, a demultiplexer 30, gain storage 31, gain decoder 32, inverse quantizer 33, and orthogonal transformer 34. The audio decoding device 3A is used in combination with the audio encoding device 1A according to the first embodiment of the present invention.

In this embodiment, the demultiplexer 30 demultiplexes, for each band including a plurality of frequency signals, the encoded audio data input frame by frame into quantized signal information and gain information for scaling the quantized signal. The gain storage 31 stores a gain used in a past frame for each band. The gain decoder 32 decodes, for each band, the gain of the frame of interest by using the past frame gain acquired from the gain storage 31 and a differential gain contained in the gain information demultiplexed by the demultiplexer 30. The inverse quantizer 33 inversely quantizes and scales the quantized signal information demultiplexed by the demultiplexer 30 for each band based on the gain obtained by the gain decoder 32, thereby generating a frequency signal. The orthogonal transformer 34 generates a decoded audio signal by orthogonally transforming the frequency signal obtained by the inverse quantizer 33.

The demultiplexer 30 demultiplexes frame number information 301 from a bit stream 300 input frame by frame, and also demultiplexes differential gain information 302 and a quantized signal 303 for each band including a plurality of frequency signals.

The gain storage 31 holds a gain used in a past frame for each band, and outputs, to the gain decoder 32, a grain G_old of the frame of interest as a past gain 308 in accordance with frame number information contained in the frame number information 301.

The gain decoder 32 decodes a gain G (304) for each band in accordance with equation (8) below from the past frame gain G_old (308) output from the gain storage 31 and differential gain information d_scf (302) contained in the gain information. In the following equation, i is the index of the band number.

[Mathematical 8]

$$G(i)=d_scf(i)+G_\mathrm{old}(i) \tag{8}$$

The inverse quantizer 33 performs inverse quantization in accordance with equation (9) below by using a quantized signal Xq (303) and the gain G (304), and outputs a frequency signal X (305).

[Mathematical 9]

$$X = Xq^{\frac{4}{3}} \cdot 2^{\frac{1}{4}(G-100)} \tag{9}$$

The orthogonal transformer 34 orthogonally transforms the frequency signal X, and outputs a decoded audio signal 306. The orthogonal transformation herein used is equivalent to inverse transformation of the orthogonal transformation used in the orthogonal transformer in the encoding device.

In this embodiment, the gain storage 31 makes it possible to use gains used in past frames. Accordingly, the code rate of the differential gain information 302 contained in the bit stream 300 can be reduced.

In this embodiment as described above, the gain information is corrected from the past frame gain and initial gain so as to suppress the gain code rate without increasing the quantization distortion amount. This makes it possible to control the gain for each band as a minimum unit, and reduce the code rate of the gain information. It is also possible to improve the sound quality with a small calculation amount by calculating the gain in accordance with predetermined transform expressions.

Consequently, high-quality decoding can be performed because the suppressed gain code rate can be used as the code rate of the quantized signal.

[Third Embodiment]

An audio encoding device and audio decoding device according to the third embodiment of the present invention will be explained below.

The audio encoding device 1A and audio decoding device 3A explained in the first and second embodiments respectively encode and decode the differential gain by using equations (5) and (8) described previously. By contrast, this embodiment performs encoding and decoding by using an average value μ of differences. The audio encoding device and audio decoding device according to this embodiment are used as a pair.

First, the audio encoding device according to this embodiment will be explained. As shown in FIG. 1, the audio encoding device according to this embodiment has a function of encoding an input audio signal 100 and outputting a bit stream 108, and includes, as main functional units, an orthogonal transformer 10, psycho-acoustic analyzer 11, gain calculator 12, quantizer 13, gain encoder 14, and multiplexer 15.

As indicated by equation (10) below, the gain encoder 14 obtains a differential gain d_scf(i) of a band i by subtracting a past frame gain G_old(i) and a common average value μ of all bands or a plurality of bands from a gain G(i) of each band.

[Mathematical 10]

$$d_scf(i)=G(i)-G_\mathrm{old}(i)-\mu \tag{10}$$

The gain encoder 14 encodes the average value μ in addition to the differential gain d_scf and frame number information indicating which past frame gain is used. The information amount of the average value μ can further be reduced by performing entropy coding such as Huffman coding. When using a Huffman code, the code rate can be reduced by designing the code length such that it decreases as the absolute value of the average value μ decreases. This is so because a signal change in the time direction is moderate in many cases.

Note that the rest of the arrangement of the audio encoding device according to this embodiment is the same as that of the audio encoding device 1A described previously, so a repetitive explanation will be omitted.

The audio decoding device according to this embodiment will now be explained. As shown in FIG. 3, the audio decoding device according to this embodiment has a function of decoding the bit stream output from the above-mentioned audio encoding device and outputting the decoded signal, and includes, as main functional units, a demultiplexer 30, gain storage 31, gain decoder 32, inverse quantizer 33, and orthogonal transformer 34.

As indicated by equation (11) below, the gain decoder 32 obtains a gain G(i) for each band from the sum of the common average value μ of all bands, the differential gain d_scf(i), and the past frame gain G_old(i). In the following equation, i is the index of the band.

[Mathematical 11]

$$G(i)=\mu+d_scf(i)+G_\mathrm{old}(i) \tag{11}$$

As described above, the average value μ is used when the magnitude of the entire signal changes. This makes it possible to reduce the code rate of the differential gain d_scf calculated for each band, thereby reducing the gain code rate.

The above-mentioned method of encoding the average value μ uses the value common to all frequency bands. However, a plurality of values may also be calculated for each unit including a plurality of bands. For example, a common code length is sometimes used for a plurality of bands when quantizing and inversely quantizing the frequency signal X in the quantizer 13 and inverse quantizer 33. Therefore, the average value μ can be encoded for every plurality of bands using a common code length in quantization and inverse quantization.

Note that the rest of the arrangement of the audio decoding device according to this embodiment is the same as that of the above-mentioned audio decoding device 3A, so a repetitive explanation will be omitted.

[Fourth Embodiment]

Figure 4:
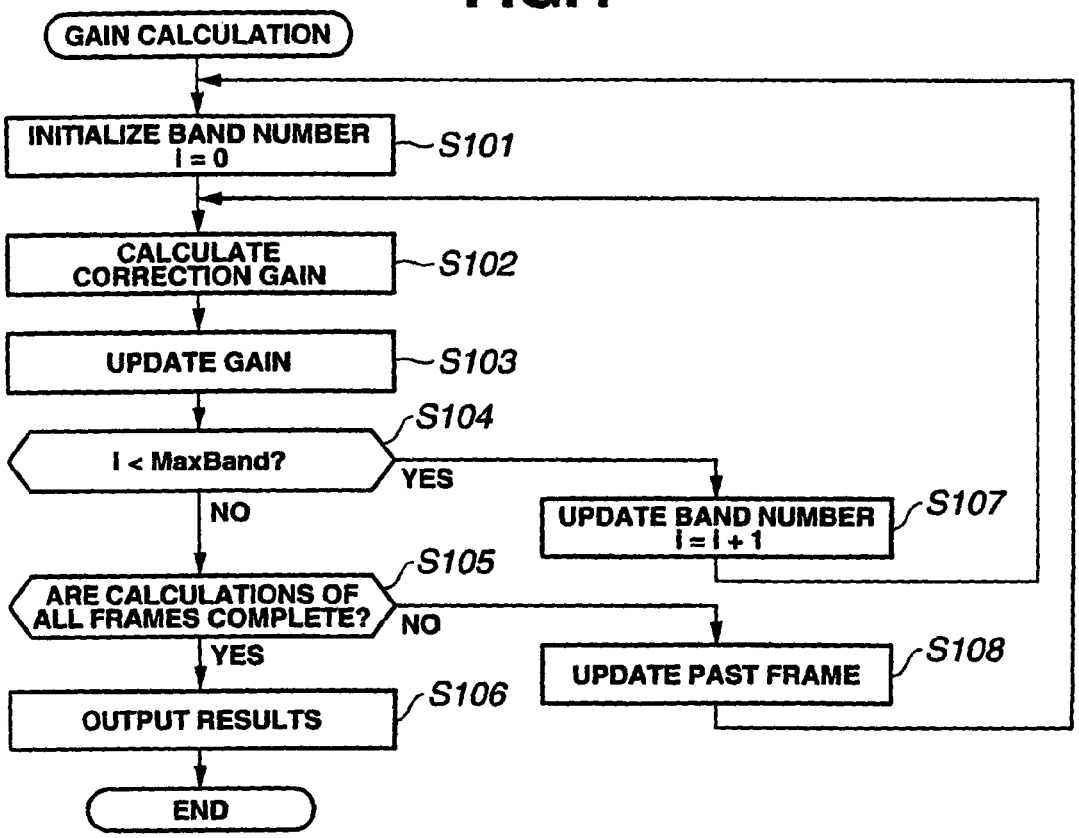
FIG. 4 is a flowchart showing a gain correcting operation in an audio encoding device according to the fourth embodiment of the present invention.

An audio encoding device according to the fourth embodiment of the present invention will be explained below with reference to FIG. 4. FIG. 4 is a flowchart showing a gain calculating operation in the audio encoding device according to the fourth embodiment of the present invention.

As shown in FIG. 1, the audio encoding device according to this embodiment has a function of encoding an input audio signal 100 and outputting a bit stream 108, and includes, as main functional units, an orthogonal transformer 10, psychoacoustic analyzer 11, gain calculator 12, quantizer 13, gain encoder 14, and multiplexer 15. The gain calculator 12 includes an initial gain calculator 20, gain corrector 21, and gain storage 22 as main functional units. This audio encoding device is used in combination with the audio decoding device 3A according to the second embodiment of the present invention.

The gain corrector 21 corrects the gains of all bands for the gain of a certain past frame k.

First, the initial value of a band number i to be corrected is set to 0 (step S101), and a correction gain is calculated from the difference between the initial gain of the band i and a past gain (step S102). The calculated correction gain is added to the initial gain, and the updated gain is set as a corrected gain (step S103).

Let MaxBand be a maximum value of the frequency band to be calculated. If i<MaxBand (step S106), the value of the band number i is updated (step S107), and the gain of the next frequency band is corrected. After corrected gains are calculated for all bands, the evaluation value of the past frame k is calculated. Whether evaluation values have been calculated for all calculable past frames is checked (step S105). If there is a calculable past frame, the value of the past frame k is updated (step S108), and the evaluation value of the new past frame is calculated. If the evaluation values of all the past frames have been calculated, a frame having a minimum past frame evaluation value is selected as a past frame, and the frame k and corrected gain are output (step S106).

Figure 5:
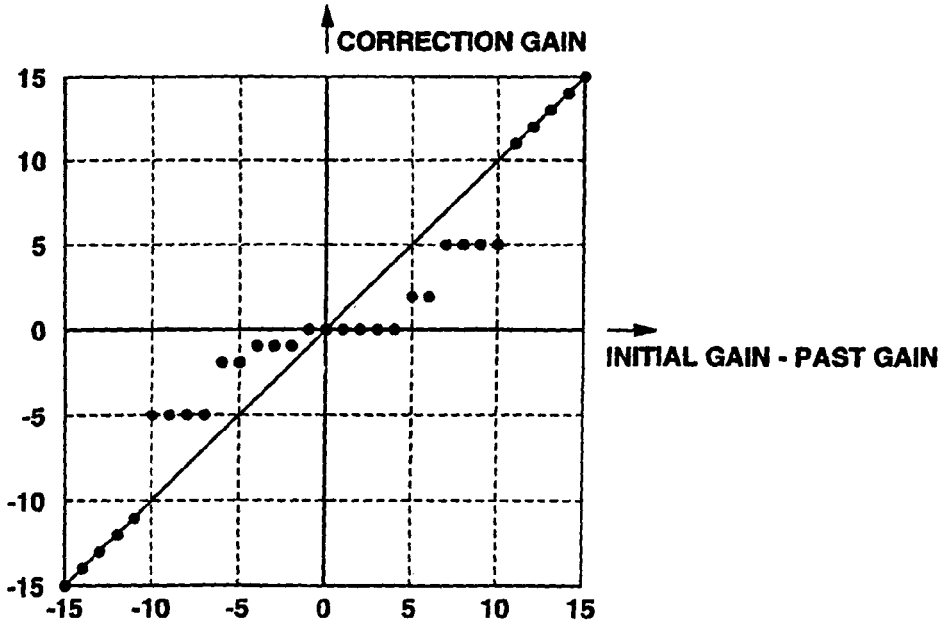
FIG. 5 is a graph showing the relationship between a correction gain and the difference between an initial gain and past gain.

The correction gain is set equal to the difference between the initial gain and past gain, or smaller than the absolute value of the difference. FIG. 5 is a graph showing the relationship between the correction gain and the difference between the initial gain and past gain. For example, as shown in FIG. 5, when the abscissa is defined by equation (12) below, the absolute value of the correction gain is set smaller than the absolute value of Gx if the absolute value of Gx is small.

[Mathematical 12]

$$Gx=\text{initial gain}-\text{past gain} \tag{12}$$

Consequently, the difference between the corrected gain to which the correction gain is applied in the gain encoder and the past gain decreases, so the gain code rate can be reduced. On the other hand, if the absolute value of Gx is large, the value of Gx is set as the correction gain. This makes it possible to encode the gain without deteriorating the sound quality when the gain has changed because the volume has abruptly increased or decreased.

Furthermore, the sound quality sometimes improves when the transform expression is changed in accordance with the sign of Gx. When the sign of Gx is negative, i.e., when the gain of the frame of interest is smaller than the past gain, the sound quality improves if correction is performed such that the correction gain approaches the initial gain instead of setting 0 as the correction gain.

In the example shown in FIG. 5, the correction gain is uniquely determined by the value of Gx. However, a high-quality correction gain can be calculated by changing the transform expression in accordance with the bit rate or the number of bits usable in the frame of interest. It is also possible to calculate a highly accurate evaluation value by performing linear transform or complicated nonlinear transform by using the value of Gx as an input.

The evaluation value of a certain past frame can be calculated from, e.g., a code rate when a gain corrected by using the past gain of a certain past frame is encoded. In this case, a past frame having the smallest code rate is selected. It is also possible to use an evaluation value calculated from the quantization distortion amount and gain code rate.

When compared to the first example of the gain corrector, the gain can be corrected with a small calculation amount because gain update (step S009) need not be performed a plurality of number of times.

Also, the audio encoding device and audio decoding device of the above-mentioned embodiments encode and decode the gain by using past frames. In this case, the calculation amount and memory amount can be reduced by restricting a maximum value of the frame number information d_frame in advance. Furthermore, when it is decided to always use the gain of an immediately preceding frame, it is possible to reduce the calculation amount because no past frame need be selected, and reduce the code rate because no past frame number information need be encoded.

Note that the rest of the arrangement of the audio encoding device according to this embodiment is the same as that of the above-mentioned audio encoding device 1A, so a repetitive explanation will be omitted.

[Fifth Embodiment]

Figure 6:
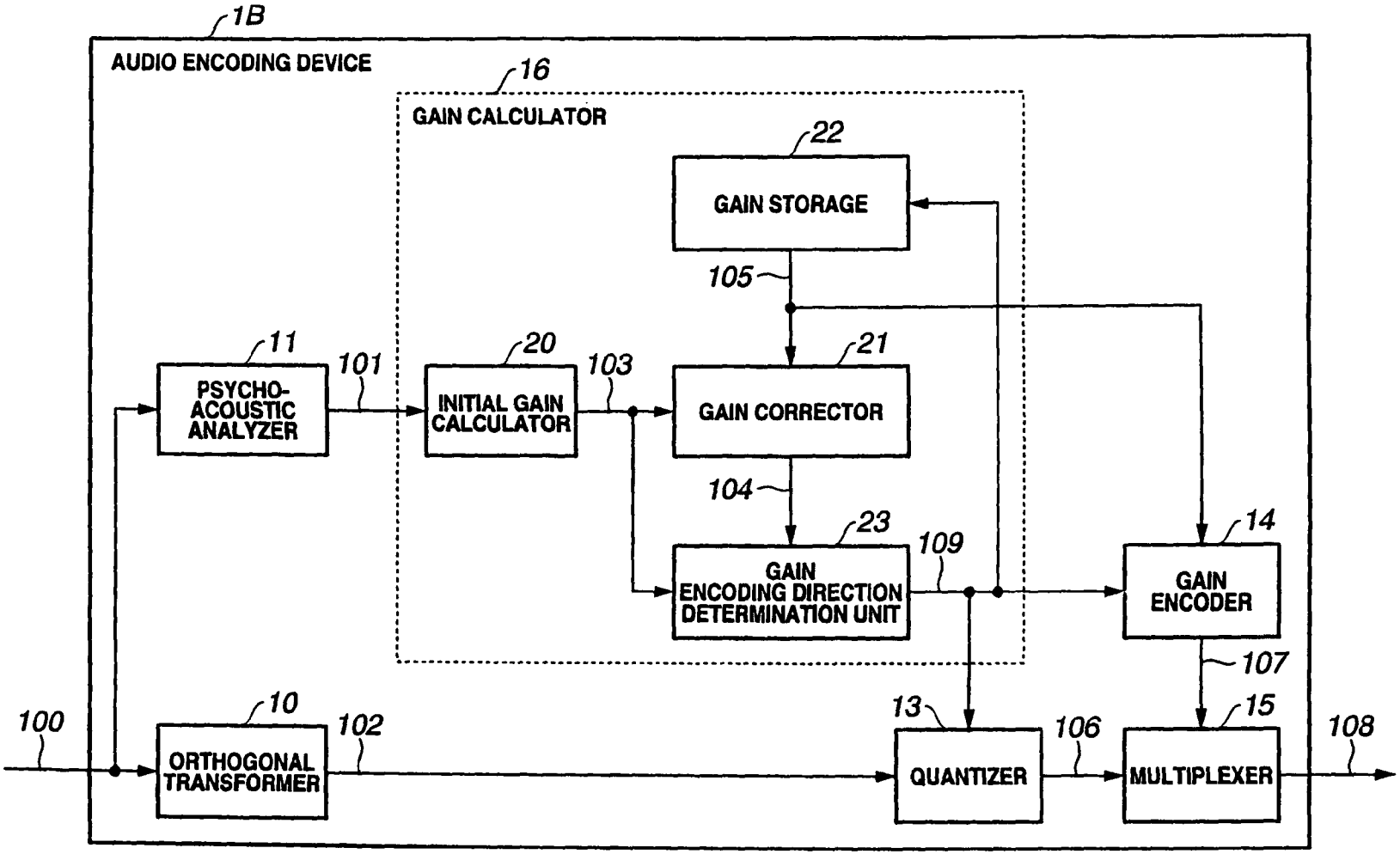
FIG. 6 is a block diagram showing the arrangement of an audio encoding device according to the fifth embodiment of the present invention.

An audio encoding device according to the fifth embodiment of the present invention will be explained below with reference to FIG. 6. FIG. 6 is a block diagram showing the arrangement of the audio encoding device according to the fifth embodiment of the present invention. The same reference numerals as in FIG. 1 denote the same or similar parts in FIG. 6.

As shown in FIG. 6, an audio encoding device 1B according to this embodiment has a function of encoding an input audio signal 100 and outputting a bit stream 108, and includes, as main functional units, an orthogonal transformer 10, psycho-acoustic analyzer 11, gain calculator 16, quantizer 13, gain encoder 14, and multiplexer 15. The gain calculator 16 includes an initial gain calculator 20, gain corrector 21, gain storage 22, and gain encoding direction determination unit 23 as main functional units.

Compared to the audio encoding device 1A of the first embodiment, the gain encoding direction determination unit 23 is added to the audio encoding device 1B according to this embodiment.

The gain encoding direction determination unit 23 of the audio encoding device 1B determines a gain to be encoded by using an initial gain 103 calculated by the initial gain calculator 20 and a corrected gain 104 corrected by the gain corrector 21. A code rate when frequency differential encoding is performed on the initial gain 103 by using above-mentioned equation (2) and a code rate when time differential encoding is performed on the corrected gain by using above-mentioned equation (5) are calculated, and a differential method that reduces the code rate is selected.

The gain is output in accordance with the selected differential method; the initial gain is output as a final gain 109 when frequency differential encoding is selected, and the corrected gain is output as the final gain 109 when time differential encoding is selected. The final gain 109 contains information of the selected differential method as well. The code rate of frequency differential encoding is calculated so as to include a code rate necessary to encode the initial value. The code rate of time differential encoding is calculated so as to include a code rate indicating a past frame number.

In the gain encoding direction determination unit 23 described above, a differential encoding method is selected based on the code rate when the initial gain undergoes frequency differential encoding, and the code rate when the corrected gain undergoes time differential encoding. However, the code rate can further be reduced in some cases by selecting a combination that minimizes the code rate from a plurality of combinations, e.g., a combination of time difference encoding of the initial gain and frequency differential encoding of the corrected gain.

The gain encoder 14 encodes the gain by using the differential method determined by the gain encoding direction determination unit 23. Gain information 107 output from the gain encoder 14 additionally contains information indicating which differential encoding method is selected. That is, the gain information 107 contains information obtained by encoding differential gain information and the initial value by using equation (2) when frequency differential encoding is selected, and contains information obtained by encoding the differential gain information and past frame number information by using equation (5) when time differential encoding is selected.

Consequently, when the frequency change of the sound is small, the gain code rate can be reduced by selecting the frequency differential encoding method. On the other hand, when the time change of the sound is small, the gain code rate can be reduced by selecting the time differential encoding method.

Note that the rest of the arrangement of the audio encoding device according to this embodiment is the same as that of the above-mentioned audio encoding device 1A, so a repetitive explanation will be omitted.

[Sixth Embodiment]

Figure 7:
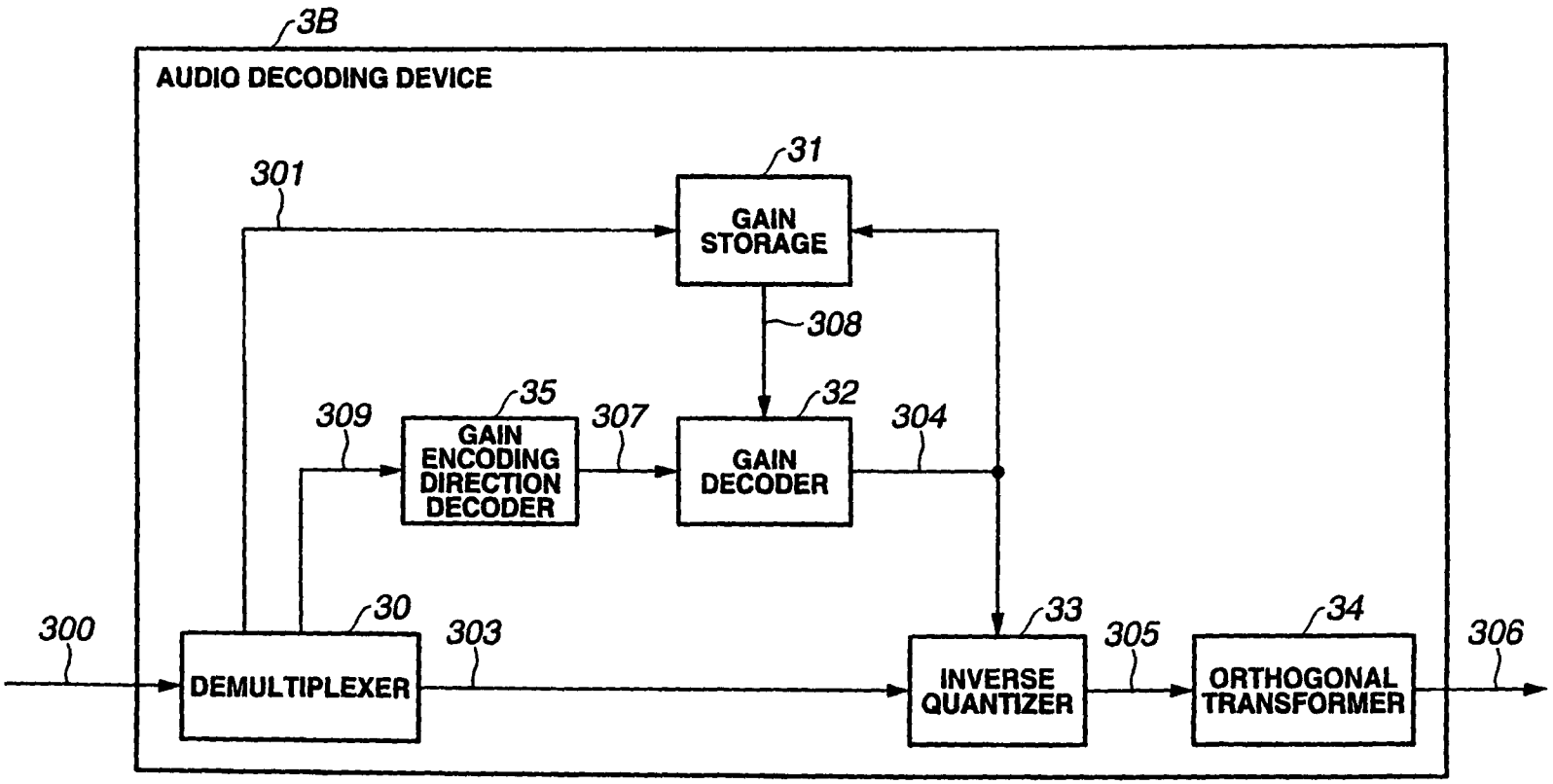
FIG. 7 is a block diagram showing the arrangement of an audio decoding device according to the sixth embodiment of the present invention.

An audio decoding device according to the sixth embodiment of the present invention will be explained below with reference to FIG. 7. FIG. 7 is a block diagram showing the arrangement of the audio decoding device according to the sixth embodiment of the present invention. The same reference numerals as in FIG. 3 denote the same or similar parts in FIG. 7.

As shown in FIG. 7, an audio decoding device 3B according to this embodiment has a function of decoding the bit stream output from the above-mentioned audio encoding device and outputting the decoded signal, and includes, as main functional units, a demultiplexer 30, gain storage 31, gain decoder 32, inverse quantizer 33, and orthogonal transformer 34. Compared to the audio decoding device 3A of the second embodiment, a gain encoding direction decoder 35 is added to the audio decoding device 3B according to this embodiment. The audio decoding device 3B is used in combination with the audio encoding device 1B according to the fifth embodiment of the present invention.

Based on a selected differential method contained in gain information 309 demultiplexed by the bit stream demultiplexer 30, the gain encoding direction decoder 35 of the audio decoding device 3B determines in which of the time direction and frequency direction a differential gain is differentially encoded. The gain decoder 32 decodes the gain from differential gain information 307 containing the differential gain and differential method information output from the gain encoding direction decoder 35 and indicating the differential method. When the differential method is the time direction, the gain decoder 32 calculates the gain of the frame of interest by using the gain of an adjacent band, the differential gain, and an initial value as represented by equation (3) described earlier. On the other hand, when the differential method is the frequency direction, the gain decoder 32 calculates the gain of the frame of interest by using the differential gain and a past frame gain output from the gain storage 31 based on past frame number information 301 as represented by equation (7) described earlier.

When differentially coding the gain in the time direction, the audio encoding device 1B according to the above-mentioned fifth embodiment or the audio decoding device 3B according to the above-mentioned sixth embodiment encodes or decodes the gain by using the past frame. In this case, the calculation amount and memory amount can be reduced by restricting a maximum value of the frame number information d_frame in advance. Furthermore, when it is decided to always use the gain of an immediately preceding frame, it is possible to reduce the calculation amount because no past frame need be selected, and reduce the code rate because no past frame number information need be encoded.

Note that the rest of the arrangement of the audio decoding device according to this embodiment is the same as that of the above-mentioned audio decoding device 3A, so a repetitive explanation will be omitted.

[Extensions of Embodiments]

In the above embodiments, the audio encoding devices and audio decoding devices have been explained by taking individual devices as examples. However, the present invention is not limited to this. That is, it is also possible to form an audio encoding/decoding apparatus by packaging an audio encoding device and audio decoding device into one apparatus. The same functions and effects as those of the above-mentioned embodiments can be obtained in this case as well.

Also, the individual functional units of the audio encoding device or audio decoding device according to each embodiment may also be implemented by dedicated signal processing circuits or arithmetic circuits, or a computer that performs digital signal processing.

Figure 8:
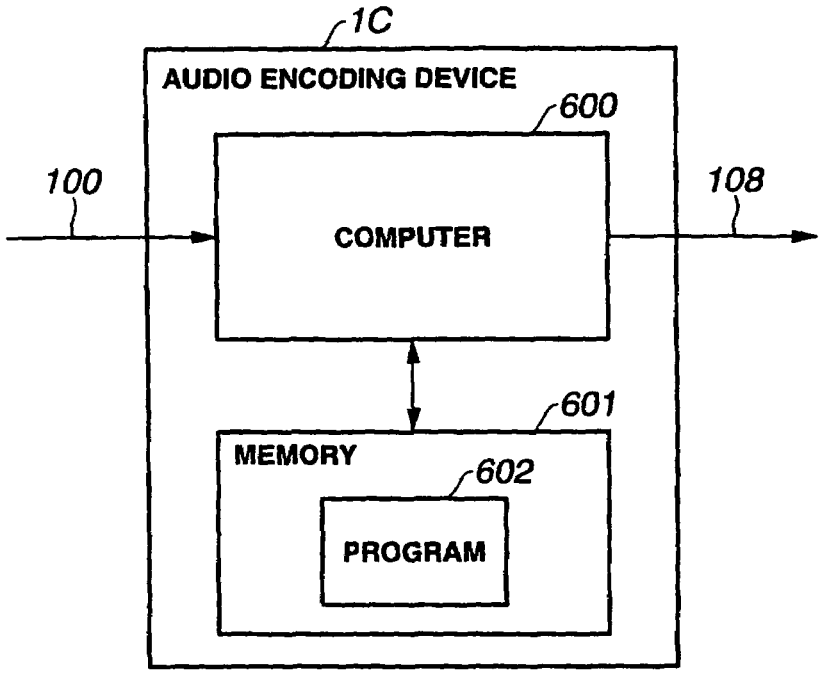
FIG. 8 is a block diagram showing a configuration example of an audio encoding device when individual functional units are implemented by a computer.

FIG. 8 is a block diagram showing a configuration example of an audio encoding device when the individual functional units are implemented by a computer. An audio encoding device 1C includes a computer 600 and memory 601.

The computer 600 has a microprocessor such as a CPU and its peripheral circuits. The computer 600 reads out a program 602 stored in the memory 601 and executes the readout program 602, thereby causing the above-mentioned hardware and program 612 to cooperate with each other, and implementing the individual functional nits of the audio encoding device according to each embodiment described above, i.e., the orthogonal transformer 10, psycho-acoustic analyzer 11, gain calculator 12, quantizer 13, gain encoder 14, and multiplexer 15 shown in FIG. 1 described earlier. Thus, the computer 600 encodes an input audio signal 100 and outputs a bit stream 108.

Figure 9:
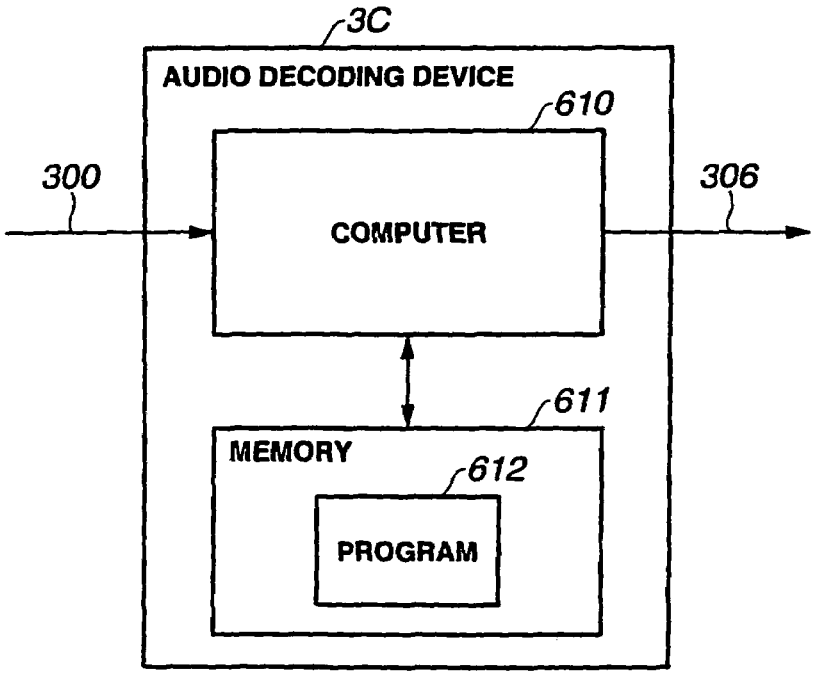
FIG. 9 is a block diagram showing a configuration example of an audio decoding device when individual functional units are implemented by a computer.
Figure 10:
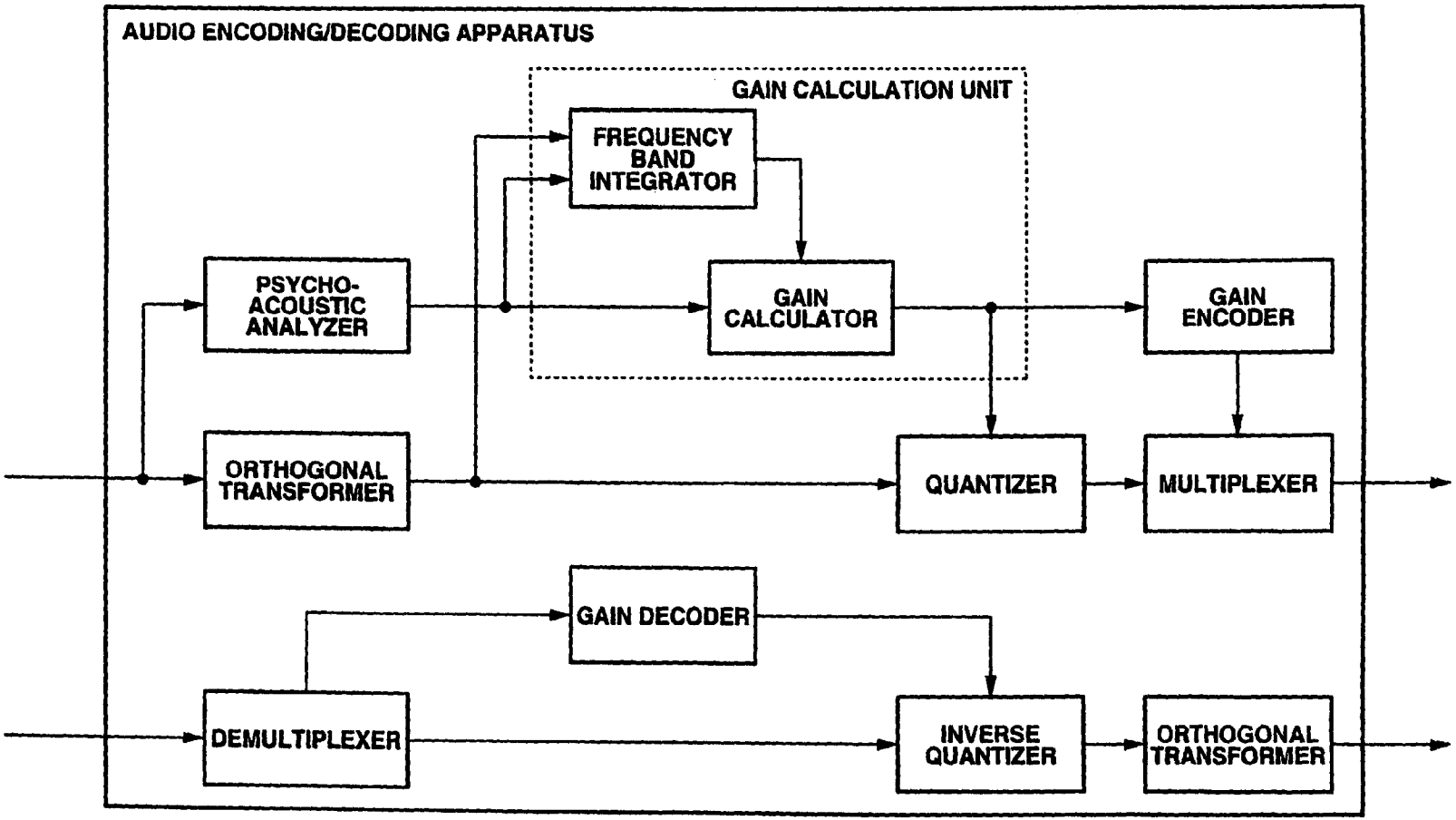
FIG. 10 is a block diagram showing the arrangement of a conventional audio encoding/decoding apparatus.

FIG. 9 is a block diagram showing a configuration example of an audio decoding device when the individual functional units are implemented by a computer. An audio decoding device 3C includes a computer 610 and memory 611.

The computer 610 has a microprocessor such as a CPU and its peripheral circuits. The computer 610 reads out a program 612 stored in the memory 611 and executes the readout program 612, thereby causing the above-mentioned hardware and program 612 to cooperate with each other, and implementing the individual functional units of the audio decoding device according to each embodiment described above, i.e., the demultiplexer 30, gain storage 31, gain decoder 32, inverse quantizer 33, and orthogonal transformer 34 shown in FIG. 3 described earlier. Thus, the computer 610 decodes a bit stream 300 and outputs a decoded audio signal 306.

Note that the different computers are used on the encoding side and decoding side in this example explained above, but it is also possible to execute processing by using the same computer on the encoding side and decoding side.

Furthermore, the audio encoding device and audio decoding device according to the embodiments construct an audio encoding/decoding system according to the present invention.

In this case, the audio encoding device encodes an input audio signal and generates encoded audio data. This encoded audio data is input to the audio decoding device via a communication network, communication line, signal line, or recording medium. The audio decoding device decodes the encoded audio data generated by the audio encoding device, and generates a decoded audio signal.

Accordingly, the audio encoding/decoding system according to the present invention corrects the gain information from the past frame gain and initial gain so as to suppress the gain code rate without increasing the quantization distortion amount. This makes it possible to control the gain for a band as a minimum unit, and reduce the code rate of the gain information. It is also possible to improve the sound quality with a small calculation amount by calculating the gain in accordance with predetermined transform expressions. Consequently, high-quality audio encoding and decoding methods, devices, and programs can be implemented because the suppressed gain code rate can be used as the code rate of the quantized signal. Furthermore, since the gain code rate is suppressed, high-quality audio encoding and decoding methods, devices, and programs can be implemented with a bit rate lower than the conventional bit rate.

Industrial Applicability

The present invention is useful as a general audio apparatus that encodes an audio signal (acoustic signal/sound signal) and exchanges the encoded audio signal. In particular, the present invention is capable of encoding with a small information amount, and suitable to obtaining a high-quality reproduction signal.

The invention claimed is:

1. An audio encoding method comprising:

in an audio encoding device:

transforming an input audio signal comprising a plurality of frames into a frequency signal for each frame of the plurality of frames of the input audio signal, the plurality of frames including a current frame and a past frame which is earlier in time than the current frame, and the frequency signal being divided into a plurality of bands;

calculating, for each band of the plurality of bands, an initial gain for scaling the frequency signal for the current frame;

correcting the initial gain by using a past gain for each band of the plurality of bands for the past frame of the plurality of frames, thereby calculating a corrected gain for each band of the plurality of bands for the current frame;

generating a quantized signal by scaling and quantizing the frequency signal for the current frame by using the corrected gain for each band of the plurality of bands for the current frame;

generating gain information by encoding, for each band of the plurality of bands for the current frame, a difference between the corrected gain and the past gain as the gain information; and generating encoded audio data by multiplexing, for each band of the plurality of bands for the current frame, the quantized signal and the gain information.

2. An audio encoding method according to claim 1, wherein the calculating of the gain comprises calculating the corrected gain based on an evaluation value calculated from an evaluation function calculated from a quantization distortion amount, and an evaluation function calculated from a gain code rate.

3. An audio encoding method according to claim 1, wherein the calculating of the gain comprises calculating the corrected gain such that an absolute value of a difference between the past gain and the corrected gain is not more than an absolute value of a difference between the past gain and an initial gain.

4. An audio encoding method according to claim 1, wherein the generating of the gain information comprises averaging, for a plurality of bands, differential gains each calculated for each band from a difference between the corrected gain and the past gain, calculating a difference between the obtained average differential value and the differential gain for each band, and encoding the differences and the average differential value as the gain information.

5. An audio encoding method according to claim 1, wherein the generating of the gain information comprises using a gain selected from past gains of a predetermined number of previous frames as the past gain, and encoding frame number information of the frame associated with the selected gain.

6. An audio encoding method according to claim 1, wherein the calculating of the gain comprises always using a gain of an immediately preceding frame as the past gain.

7. An audio encoding method according to claim 1, wherein the calculating of the gain comprises selecting, based on an uncorrected gain and a corrected gain, one of a time direction and a frequency direction as a differential encoding direction in which a gain of a frame of interest is to be differentially encoded, and the encoding of the gain comprises differentially encoding the gain in accordance with the differential encoding direction.

8. An audio decoding method comprising:

in an audio decoding device:

demultiplexing encoded audio data which includes a plurality of frames and is input frame by frame into the audio decoding device, the plurality of frames including a current frame and a past frame which is earlier in time than the current frame, and the demultiplexing of the encoded audio data comprising demultiplexing quantized signal information and gain information for scaling a quantized signal from the encoded audio data, the quantized signal being divided into a plurality of bands;

storing in a memory, a past gain for each band of the plurality of bands for the past frame;

decoding a gain for each band of the plurality of bands for the current frame by using:

the past gain for each band of the plurality of bands for the past frame acquired from the memory; and a differential gain included in the demultiplexed gain information;

inversely quantizing and scaling the demultiplexed and quantized signal information for each band of the plurality of bands for the current frame based on the gain obtained in the decoding of the gain, thereby generating a frequency signal for the current frame; and generating a decoded audio signal by orthogonally transforming the frequency signal for the current frame, wherein the gain information includes, for each band of the plurality of bands for the current frame, frame number information indicating the past frame, and a differential gain between the past gain of the past frame and the gain of the current frame, and wherein the decoding of the gain comprises acquiring, for each band of the plurality of bands for the current frame, the past gain of the past frame corresponding to the frame number information of the gain information from the memory, and calculating the gain for each band of the plurality of bands for the current frame from the past gain and the differential gain of the gain information.

9. An audio decoding method according to claim 8, wherein the gain information includes differential method information indicating one of a time-direction differential encoding method and a frequency-direction differential encoding method by which the differential gain of the frame of interest is differentially encoded, and the decoding of the gain comprises calculating the gain in accordance with the differential encoding method corresponding to the differential method information of the gain information.

10. An audio encoding device comprising:

an orthogonal transformer which transforms an input audio signal comprising a plurality of frames into a frequency signal for each frame of the plurality of frames in the input audio signal, the plurality of frames including a current frame and a past frame which is earlier in time than the current frame, and the frequency signal being divided into a plurality of bands;

a gain calculator which:

calculates, for each band of the a plurality of bands, an initial gain for scaling each band of the plurality of bands in the frequency signal for the current frame; and corrects the initial gain by using a past gain for each band of the plurality of bands for the past frame of the plurality of frames, thereby calculating a corrected gain for each band of the plurality of bands for the current frame;

a quantizer which generates a quantized signal by scaling and quantizing the frequency signal for the current frame by using the corrected gain for each band of the plurality of bands for the current frame;

a gain encoder which generates gain information by encoding, for each band of the plurality of bands for the current frame, a difference between the corrected gain obtained by said gain calculator and a corresponding past gain as the gain information; and a multiplexer which generates encoded audio data by multiplexing, for each band of the plurality of bands for the current frame, the quantized signal obtained by said quantizer and the gain information obtained by said gain encoder.

11. An audio encoding device according to claim 10, wherein said gain calculator calculates the corrected gain based on an evaluation value calculated from an evaluation function calculated from a quantization distortion amount, and an evaluation function calculated from a gain code rate.

12. An audio encoding device according to claim 10, wherein said gain calculator calculates the corrected gain such that an absolute value of a difference between the past gain and the corrected gain is not more than an absolute value of a difference between the past gain and an initial gain.

13. An audio encoding device according to claim 10, wherein said gain encoder:

averages, for a plurality of bands, a differential gain calculated for each band of the plurality of bands from a difference between the corrected gain and the past gain;

calculates a difference between the obtained average differential value and the differential gain for each band of the plurality of bands; and encodes the difference and the average differential value as the gain information.

14. An audio encoding device according to claim 10, wherein said gain encoder uses a gain selected from past gains of a predetermined number of previous frames as the past gain, and encodes frame number information of the frame associated with the selected gain.

15. An audio encoding device according to claim 10, wherein said gain calculator always uses a gain of an immediately preceding frame as the past gain.

16. An audio encoding device according to claim 10, wherein said gain calculator selects, based on an uncorrected gain and a corrected gain, one of a time direction and a frequency direction as a direction in which a gain of a frame of interest is to be differentially encoded, and wherein said gain encoder differentially encodes the gain in accordance with the differential encoding direction selected by said gain calculator.

17. An audio decoding device comprising:

a demultiplexer which demultiplexes encoded audio data which includes a plurality of frames and is input frame by frame into the audio decoding device, the plurality of frames including a current frame and a past frame which is earlier in time than the current frame, and the demultiplexing of the encoded audio data comprising demultiplexing quantized signal information and gain information for scaling a quantized signal from encoded audio data, the quantized signal being divided into a plurality of bands;

a memory which stores a past gain for each band of a plurality of bands for the past frame;

a gain decoder which decodes a gain for each band of a plurality of bands for the current frame by using:

the past gain for each band of the plurality of bands for the past frame stored in said memory; and a differential gain included in the gain information demultiplexed by said demultiplexer;

an inverse quantizer which inversely quantizes and scales the quantized signal information demultiplexed by said demultiplexer for each band of the plurality of bands for the current frame based on the gain decoded by said gain decoder, thereby generating a frequency signal for the current frame; and an orthogonal transformer which generates a decoded audio signal by orthogonally transforming the frequency signal for the current frame generated by said inverse quantizer, wherein the gain information includes, for each band of the plurality of bands for the current frame, frame number information indicating the past frame, and a differential gain between the past gain of the past frame and the gain of the current frame, and wherein said gain decoder acquires, for each band of the plurality of bands for the current frame, the past gain of the past frame corresponding to the frame number information of the gain information from said memory, and calculates the gain for each band of the plurality of bands for the current frame from the past gain of the past frame and the differential gain of the gain information.

18. An audio decoding device according to claim 17, wherein the gain information includes differential method information indicating one of a time-direction differential encoding method and a frequency-direction differential encoding method by which the differential gain of the frame of interest is differentially encoded, and wherein said gain decoder calculates the gain in accordance with the differential encoding method corresponding to the differential method information of the gain information.

19. A programmable non-transitory storage medium tangibly embodying a program of machine-readable instructions executable by a digital processing apparatus to perform the audio encoding method of claim 1.

20. A programmable non-transitory storage medium tangibly embodying a program of machine-readable instructions executable by a digital processing apparatus to perform the audio decoding method of claim 8.

21. An audio encoding/decoding system comprising:

an audio encoding device which generates encoded audio data by encoding an input audio signal; and an audio decoding device which generates a decoded audio signal by decoding the encoded audio data generated by said audio encoding device, wherein said audio encoding device comprises:

an orthogonal transformer which transforms an input audio signal comprising a plurality of frames into a frequency signal for each frame of the plurality of frames, the plurality of frames including a current frame and a past frame which is earlier in time than the current frame, and the frequency signal being divided into a plurality of bands;

a gain calculator which:

calculates, for each band of the plurality of bands, an initial gain for scaling each band of the plurality of bands for the current frame; and corrects the initial gain by using a past gain for each band of the plurality of bands for the past frame, thereby calculating a corrected gain for each band of the plurality of bands for the current frame;

a quantizer which generates a quantized signal by scaling and quantizing the frequency signal for the current frame by using the corrected gain for each band of the plurality of bands for the current frame;

a gain encoder which generates gain information by encoding, for each band of the plurality of bands for the current frame, a difference between the corrected gain obtained by said gain calculator and the past gain as the gain information; and a multiplexer which generates encoded audio data by multiplexing, for each band of the plurality of bands for the current frame, the quantized signal obtained by said quantizer and the gain information obtained by said gain encoder, and wherein said audio decoding device comprises:

a demultiplexer which demultiplexes encoded audio data which includes a plurality of frames and is input frame by frame into the audio decoding device, the plurality of frames including a current frame and a past frame which is earlier in time than the current frame, and the demultiplexing of the encoded audio data comprising demultiplexing quantized signal information and gain information for scaling the quantized signal from the encoded audio data generated by said audio encoding device, the quantized signal being divided into a plurality of bands;

a memory which stores a past gain for each band of the plurality of bands for the past frame;

a gain decoder which decodes a gain for each band of a plurality of bands for the current frame by using:

the past gain for each band of the plurality of bands for the past frame acquired from said memory; and a differential gain included in the gain information demultiplexed by said demultiplexer;

an inverse quantizer which inversely quantizes and scales the quantized signal information demultiplexed by said demultiplexer for each band of the plurality of bands for the current frame based on the gain obtained by said gain decoder, thereby generating a frequency signal for the current frame; and an orthogonal transformer which generates a decoded audio signal by orthogonally transforming the frequency signal for the current frame obtained by said inverse quantizer.

* * * * *